US008579008B2

(12) United States Patent
Svenson

(10) Patent No.: US 8,579,008 B2
(45) Date of Patent: Nov. 12, 2013

(54) HINGE ASSEMBLY FOR A FOLDING CLOSURE

(75) Inventor: Mike Svenson, Chesterville (CA)

(73) Assignee: Dynamic Closures, Cornnale (CA)

( * ) Notice: Subject to any disclaimer, the term of this patent is extended or adjusted under 35 U.S.C. 154(b) by 1466 days.

(21) Appl. No.: 11/134,184

(22) Filed: May 23, 2005

(65) Prior Publication Data

US 2006/0260768 A1 Nov. 23, 2006

(51) Int. Cl.
*E06B 3/12* (2006.01)

(52) U.S. Cl.
USPC ..... 160/235; 16/225; 16/355

(58) Field of Classification Search
USPC ..... 160/183, 235, 236, 199, 206, 233, 160/229.1, 232, 196.1; 16/225, 355
See application file for complete search history.

(56) References Cited

U.S. PATENT DOCUMENTS

| | | | | | |
|---|---|---|---|---|---|
| 1,017,808 | A | * | 2/1912 | Rush | 160/235 |
| 1,995,254 | A | | 3/1935 | Spaunburg | |
| 1,995,255 | A | | 3/1935 | Olsen | |
| 2,066,444 | A | | 1/1937 | Albert | |
| 3,092,870 | A | * | 6/1963 | Baer | 16/277 |
| 3,570,579 | A | * | 3/1971 | Matsushima | 160/235 |
| 4,660,613 | A | * | 4/1987 | Dagenais | 160/199 |
| 4,953,261 | A | | 9/1990 | Lyons | |
| 5,220,951 | A | * | 6/1993 | Dagenais | 160/199 |
| 5,575,322 | A | * | 11/1996 | Miller | 160/133 |
| 6,170,210 | B1 | | 1/2001 | Marts | |
| 6,772,905 | B2 | | 8/2004 | Cheng | |

* cited by examiner

*Primary Examiner* — Katherine Mitchell
*Assistant Examiner* — Candace L Bradford

(57) ABSTRACT

A hinge assembly having a hinge member and two adjacent panels. The hinge member is elongated with an inner surface that is slightly dished. There is an entry slot in the center of the inner surface extending inwardly into the member, the entry slot diverging into two curved branch slots extending in opposite directions. Each panel has a curved hinge element at each side of the panel with one hinge element curved in one direction and the other hinge element curved in the other direction, both hinge elements also curved toward each other. The hinge elements of the adjacent panels are mounted in the hinge member, the hinge elements passing together into the central slot and then diverging from each other into the branch slots. The panels can be moved in the slots between a folded position where they are almost parallel and an unfolded position where they are against the inner surface, almost aligned, and extending away from each other.

18 Claims, 3 Drawing Sheets

HINGE ASSEMBLY FOR A FOLDING CLOSURE

BACKGROUND OF THE INVENTION

1. Field of the Invention

This invention is directed toward a hinge assembly for a folding closure. The closure is of the type having vertical closure panels, the closure folding in a horizontal direction. The hinge assembly is of the type employing a hinge member to pivotably connect the adjacent ends of adjacent panels. The invention is also directed toward a folding closure using the hinge assembly.

2. Description of the Related Art

Hinge assemblies employing a hinge member to pivotably connect adjacent ends of adjacent closure panels are known. Examples are shown in U.S. Pat. Nos. 3,570,579 and 4,953,261. These known assemblies however can be complicated in construction, can be relatively large, and are not always suited for connecting vertical panels. Folding closures made from the known hinge assemblies can be somewhat unsightly in appearance since the hinge assemblies do not always provide a neat and compact construction.

SUMMARY OF THE INVENTION

It is the purpose of the present invention to provide a hinge assembly which is simple in construction, compact, easy to assembly and to operate, and which is well suited for connecting vertical panels. It is also the purpose of the present invention to provide a folding closure which is simple in construction, neat in appearance, compact, easy to assembly and operate, and suited for use with vertical closure panels.

In accordance with the present invention there is provided an elongated hinge assembly having a separate hinge member with slot means opening into the member from one side of the member. The slot means receive hinge elements on the adjacent sides of adjacent panels, to movably connect the panels to the hinge member. The panels in the slot means in the hinge member are movable between a folded position, where the panels are near each other, and an unfolded position where the panels extend away from each other and are nearly aligned. The panels are limited by the hinge member to unfolding to an included angle between the panels that is slightly less than 180°. The arrangement permits the assembly to be easily folded from the unfolded position. The assembly includes means for retaining the panels in position on the hinge member when the panels are vertical. The panels, including the hinge elements, are preferably made from a sheet of uniform thickness simplifying construction.

A folding closure employing a plurality of the hinge assemblies has the hinge assemblies alternating on opposite sides of the closure. Except for the end panels in the closure, each panel is connected by the hinge elements on its two sides to two different hinge members, thus forming part of two adjacent hinge assemblies, the two hinge assemblies on opposite sides of the closure. Each panel has a first hinge element at one side curving back toward one surface of the panel and a second hinge element at the other side curving back toward the other surface of the panel. This structure allows the hinge assemblies to alternate on opposite sides of the closure.

The closure is suspended by trolley means from a top rail, there normally being a trolley means mounted on the top of every second panel. Retaining means are provided on the top and bottom of each hinge member to retain the panels of each hinge assembly connected to the hinge member when the closure is suspended.

The invention is particularly directed toward a hinge assembly having a hinge member and two adjacent panels. The hinge member is elongated with an inner surface and an outer surface extending outwardly from one side of the inner surface to the other side. The hinge member has an entry slot in the center of inner surface extending inwardly, the entry slot diverging into two branch slots curving away from each other toward the sides of the inner surface. The inner surface is slightly dished outwardly toward the outer surface between its two sides. Each panel has a curved hinge element at each side of the panel with one hinge element curved in one direction and the other hinge element curved in the other direction, both hinge elements also curved toward each other. The hinge elements of the adjacent panels are mounted in the hinge member, the hinge elements passing together into the central slot and then diverging from each other into the branch slots. The panels can be slid relative to the hinge member to have the panels nearly adjacent in a folded position or to have the panels adjacent the inner surface, nearly aligned, in an unfolded position extending away from each other. The slightly dished inner surface of the hinge member prevents the panels from aligning in the unfolded position.

The invention is also particularly directed toward a folding closure having a plurality of elongate panels, each panel having parallel sides with a first hinge element on one side curving away from one surface of the panel and back toward the other side and a second hinge element on the other side curving away from the other surface of the panel and back toward the one side. The panels are joined by hinge members, each hinge member joining the adjacent sides of two adjacent panels, every second hinge member being on the opposite side of the closure. The hinge member is elongated with an inner surface and an outer surface extending outwardly from one side of the inner surface to the other side. The hinge member has an entry slot in the center of inner surface extending inwardly, the entry slot diverging into two branch slots curving away from each other toward the sides of the inner surface. The inner surface is slightly dished outwardly toward the outer surface between its two sides. The hinge elements of the adjacent panels are mounted in the hinge member, the hinge elements passing together into the central slot and then diverging from each other into the branch slots. The panels can be moved relative to the hinge member to have the panels nearly adjacent in a folded position or to have the panels adjacent the inner surface, nearly aligned, in an unfolded position extending away from each other. The slightly dished inner surface of the hinge member prevents the panels from aligning in the unfolded position.

DESCRIPTION OF PREFERRED EMBODIMENT

Figure 1:
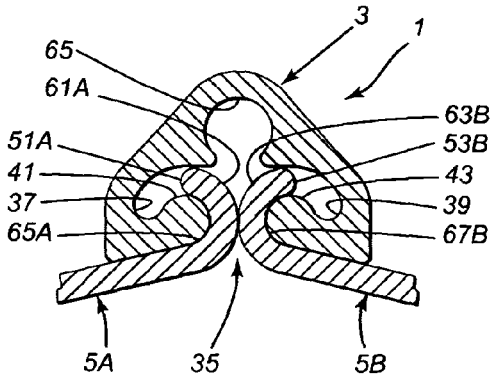
FIG. 1 is a cross-sectional view of hinge assembly with the adjacent panels in an unfolded position.
Figure 2:
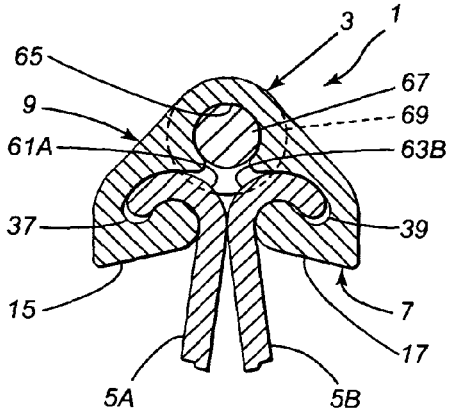
FIG. 2 is a cross-sectional view similar to FIG. 1 but with the panels in a folded position.

The hinge assembly 1 of the present invention, as shown in FIGS. 1 and 2, has a hinge member 3 joining the adjacent sides of two adjacent panels 5A, 5B.

Figure 3:
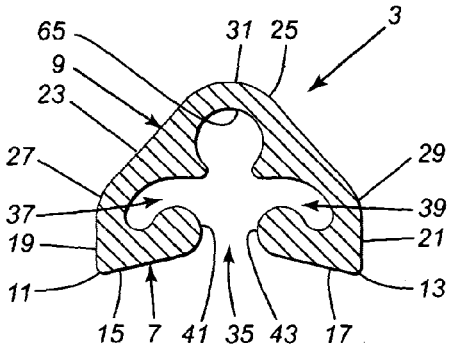
FIG. 3 is a cross-sectional view of a hinge member.

The hinge member 3, as shown in FIG. 3, is an elongate, extruded member having an inner surface 7 and an outer surface 9 extending outwardly and from one side 11 of the inner surface 7 to the other side 13. The inner surface 7 is dished slightly out toward the outer surface between its sides 11, 13. Preferably, the inner surface 7 is formed by two straight inner surface sections 15, 17, each angled slightly outwardly in extending toward each other from the sides 11, 13 respectively. Alternatively, the inner surface 7 can be made slightly convex between its sides 11, 13.

The outer surface 9 can be formed by angled surface sections comprising two parallel side surface sections 19, 21 extending outwardly from the sides 11, 13 of the inner surface 7 and two angled surface sections 23, 25 extending outwardly and toward each other from the outer sides 27, 29 of the parallel side surface sections 19, 21. The angled surface sections 23, 25 connect at a peak 31 opposite the center of the inner surface 7. While the outer surface has been described as being formed by four angled surface sections, it could also be formed by a curved surface replacing the angled surface sections 23, 25. Alternatively, all four angled surface sections could be replaced by a curved surface which is part circular or part elliptical.

The hinge member 3 has an entry slot 35 in the center of the inner surface 7 extending inwardly toward the peak 31. The entry slot 35 diverges within the hinge member into two branch slots 37, 39, each branch slot curving away from the other branch slot and toward one side of the inner surface 7. The sides of the entry slot 35 curve smoothly inwardly from the inner surface sections 15, 17 and merge smoothly with the inner convex surface of each curved branch slot 37, 39 to form diverging part-circular arcs 41, 43.

Each panel 5A, 5B is identical so only will be described in detail. Panel 5A is an elongated member having parallel side edges 51A, 53A joining side surfaces 55A, 57A. The section of the panel adjacent side edge 51A is curved outwardly of side surface 55A and rearwardly to form a first curved hinge element 61A. The section of the panel adjacent the other side edge 53A is curved outwardly of the other side surface 57A and rearwardly to form a second curved hinge element 63A. It will be seen that the first and second curved hinge elements 61A, 63A curve in opposite directions and are on opposite side surfaces of the panel. The hinge elements 61A and 63A are preferably curved in a part-circular arc extending between about 150° and 170°. The inner concave surface 65A, 67A of each hinge element 61A, 63A matches the curvature of the part-circular arcs 41, 43 in the hinge member 3. Preferably, the panel 5A is made from a sheet of uniform thickness. The panel can be made from suitable metal such as aluminum or a suitable plastic material. The panel can be extruded to its final shape or cut to size and rolled to form the hinge sections.

A through hole 65 extends through the hinge member 3. The through hole 65 is located opposite the entry slot 35 and near the peak 31. The through hole 31 intersects the branch slots 37, 39 and opens to the entry slot 35. The arrangement allows the hinge member 3 to be easily extruded.

The hinge assembly 1 is assembled by placing the hinge element 61A of one panel 5A in one side of the entry slot 35 in the hinge member 3 and in the branch slot 37 on that side as shown in FIG. 1. The other panel 5B is flipped relative to the panel 5A. Depending on how the panel 5B is flipped, either hinge element 61B or 63B can connect to the hinge member 3. Assuming hinge element 63B is used, it is oppositely curved to hinge element 61A and is placed in the other side of the entry slot 35 and in the branch slot 39 on that side of the entry slot 35. The two hinge elements 61A, 63B of the two panels 5A, 5B can abut in the entry slot 35 but flare away from each other into the branch slots 37, 39 respectively. The entry slot 35, at its narrowest point, is just slightly wider than the combined width of the two hinge elements 61A, 63B and each branch slot 37, 39 is just slightly wider than each hinge element.

The part-circular inner concave surface 65A of the hinge element 61A of the panel 5A has the same curvature as the part-circular convex arc 41 within the entry slot 35 and branch slot 37. The part-circular inner concave surface 67B on the hinge element 63B of the panel 5B similarly has the same curvature as the part-circular convex arc 43 within the inlet slot 35 and the branch slot 39. The panels 5A, 5B, in the folded position as seen in FIG. 2, are close to being parallel. In the folded position, the hinge elements 61A, 63B have moved well into the branch slots. 37, 39.

The panels 5A, 5B, in the position shown in FIG. 1, are in the unfolded position. In this position, the panel 5A lies flush against the angled section 15 of the inner surface 7 between the side 11 and the entry slot 35 and the panel 5B lies flush against the angled section 17 of the inner surface 7 between the side 13 and the entry slot 35. The included angle between the panels ranges between about 150° and 170°. The angled sections 15, 17 prevent the panels 5A, 5B from becoming aligned when they unfold which could prevent the panels from properly folding when forming part of a folding closure. The hinge elements 61A, 63B are long enough, when the panels are unfolded, to just remain in the branch slots 37, 39 and thus the panels do not separate from the hinge member 3.

Figure 4:
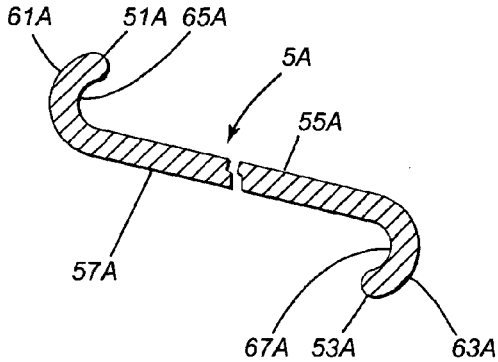
FIG. 4 is a cross-sectional view of a panel.

The panels 5A, 5B can be retained in the hinge member 3 by inserting fasteners 67 into the through hole 65 at the top and bottom ends of the hinge member 3. The fasteners 67 are selected to have a head 69, shown in dotted lines in FIGS. 3 and 4, large enough to extend over a portion of the branch slots 37, 39 and thus provide a stop for the hinge elements 61A, 63B to prevent them from leaving the hinge member 3 when the hinge member is vertical. While a though hole 65 has been shown in the hinge member 3 for receiving the fasteners 67, the through hole 65 can be replaced by relatively short blind holes drilled a short way into the hinge member 3 from both its top and bottom ends.

Figure 5:
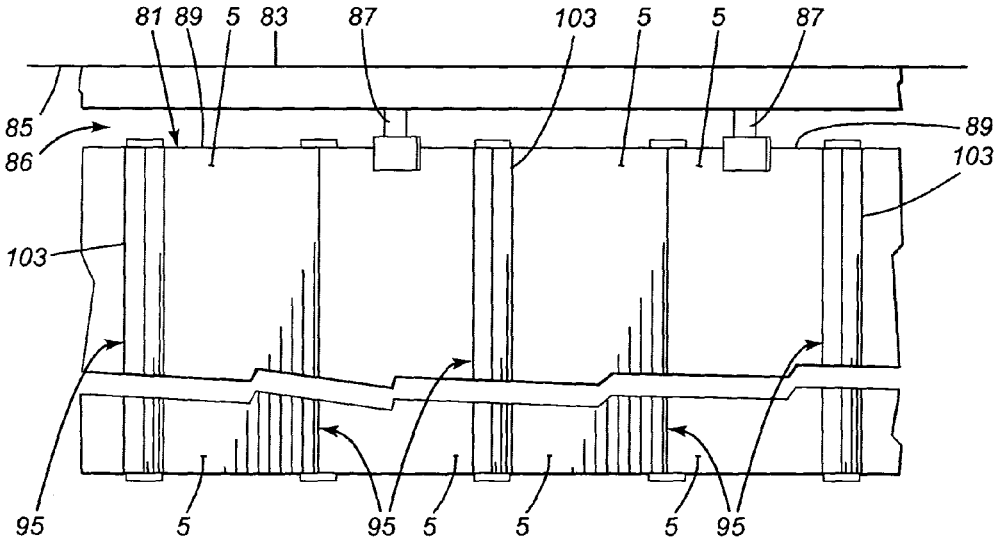
FIG. 5 is a partial elevation view of a closure incorporating many hinge assemblies.
Figure 6:
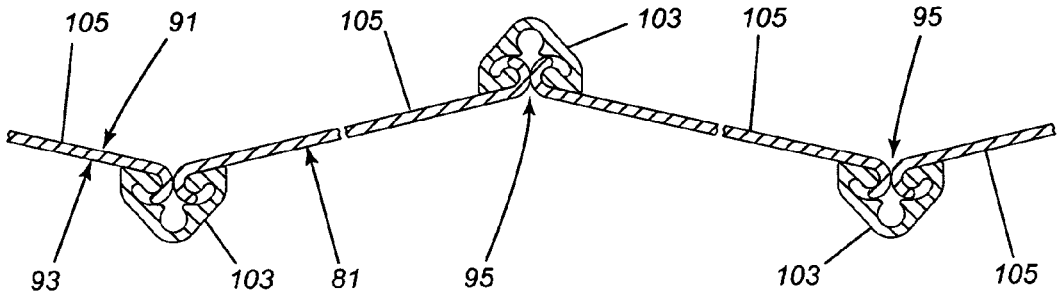
FIG. 6 is a cross-section view taken along line 6-6 in FIG. 5.

A plurality of hinge assemblies 1 form a folding closure 81 that closes an opening. Except for the end panels (not shown) of the closure, each panel 5 forms part of two adjacent hinge assemblies 1. As shown in FIG. 5, the closure 81 is suspended from a rail 83 at the top 85 of an opening 86 by roller members 87 attached to the center of the top 89 of every second panel 5. The rollers (not shown) on the roller members 87 ride within the rail 83. The roller members 87 are mounted on the panels so the rollers can rotate about a vertical axis relative to the panels 5. Every panel 5 is connected to two hinge members 3, one hinge member on one side 91 of the closure 81 and the hinge member other on the other side 93 of the closure as shown in FIG. 6. The hinge members 3 alternate on the two sides 91, 93 of the closure. Every pair of adjacent panels 5, with a connecting hinge member 3 forms a hinge assembly 95.

Figure 7:
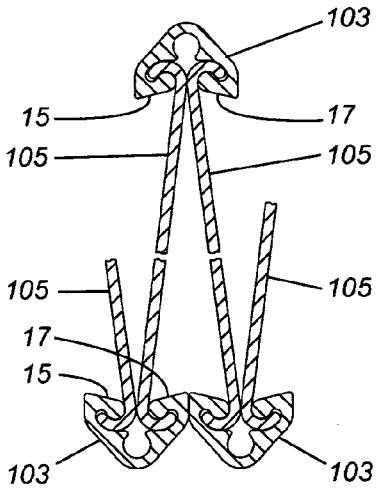
FIG. 7 is a cross-section view similar to FIG. 6 but with the panels folded.

When the closure 1 is opened, the panels 5 each pivot about their two vertical hinge members 3 to fold up against one another and against one side (not shown) of the opening 86, the panels 5 coming together to be nearly parallel as shown in FIG. 7 and the hinge members 3 abutting on each side of the closure. As the closure folds and the panels 5 come together, the hinge elements 61, 63 on each panel 5 move deeper into the branch slots 37, 39 on adjacent hinge members 3 as shown in FIG. 2. When the closure 81 is closed, the panels 5 unfold, pivoting away from each other, the hinge elements 61, 63 moving partly out of the branch slots 37, 39 as shown in FIG. 1. The adjacent panels 5 associated with each hinge member 3 contact the angled sides 15, 17 on the inner surface of the hinge member, preventing the panels from becoming aligned which could make it difficult to refold the panels.

Figure 8:
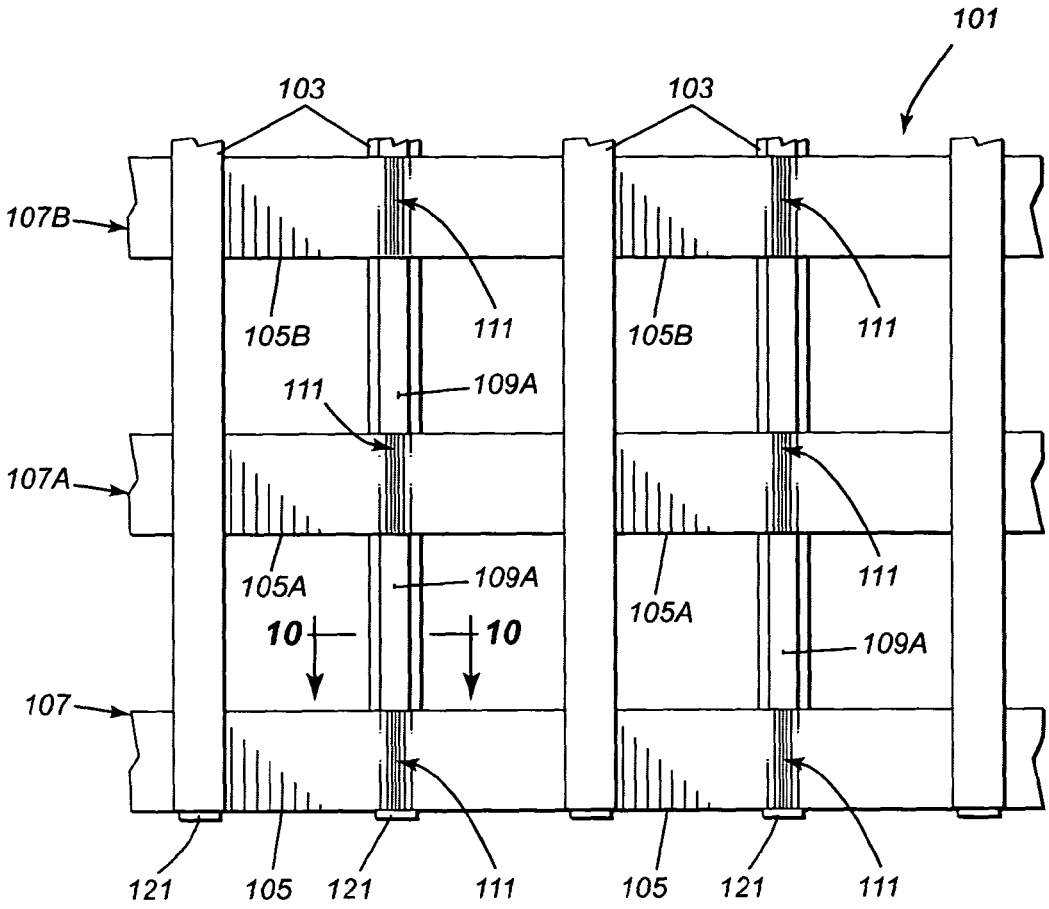
FIG. 8 is a partial elevation view of a closure incorporating short panels.
Figure 9:
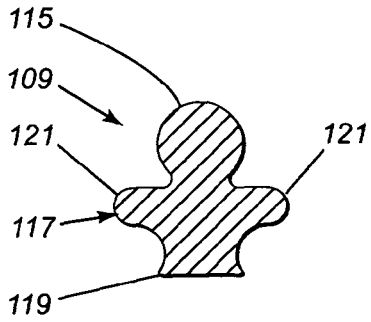
FIG. 9 is a cross-sectional view a spacer used in the closure shown in FIG. 8.
Figure 10:
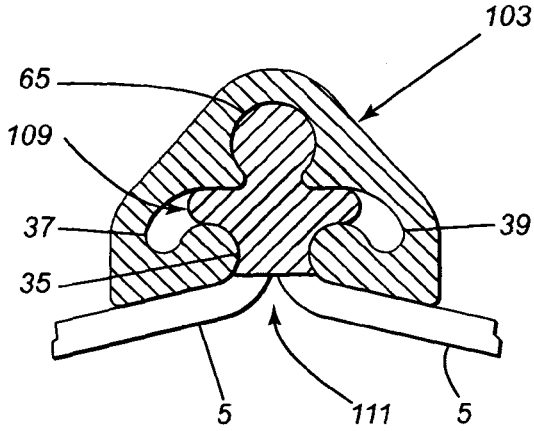
FIG. 10 is a cross-sectional view taken along line 10-10 in FIG. 8.

In the embodiment just described it will be obvious that the panels 5 and the hinge members 3 forming the closure 81 are as long as needed to close the opening. However, the panels could be made much shorter if desired to give the closure an open look. As shown in FIG. 8 the closure 101 has hinge members 103 extending over the height of the closure. Panels 105, 105A, 105B, etc. that are relatively short, form a series of horizontal rows of panels 107, 107A, 107B, etc. in the closure when it is open. Spacers 109 separate the panels in each row from the adjacent rows.

In more detail, the hinge members 103 are identical to the hinge members 3. The panels 105 are also the same as the panels 5 but only shorter. Adjacent panels 105, 105A, 105B, etc. in each row 107, 107A, etc. form, together with the hinge member 103 they are connected to, hinge assemblies 111. The hinge members 103 alternate on the sides of the closure, as do the hinge assemblies 111 for each row of panels.

The spacers 109 each have a cross-sectional shape that allows it to slide within the slots 35, 37, 39 and the through opening 65 in the hinge members 3. The spacer 109 can be an extruded member having a cylindrical portion 115, a winged portion 117, and a flared portion 119 as seen in cross-section. The cylindrical portion 115 is sized to fit in the through hole 65 in the hinge member; the winged portion 117 is sized to have the arms 121 fit partly in the branch slots 37, 39; and the flared portion 119 is sized to fit in the entry slot 35 and close it. The cylindrical and winged portions 115, 117 retain the spacer 109 within the slots 35, 37, 39 and the through opening 65 in the hinge member 3.

The closure 101 is assembled by starting from the bottom with a first row 107 of short panels 105 extending horizontally across a vertical set of hinge members 103. A hinge assembly 111 is formed at each hinge member 103 by adjacent sides of adjacent panels 105 connecting to the hinge member 103. It will be seen that the hinge members 103 alternate on opposite sides of the closure 101 across the width of the closure.

Fasteners 121 are mounted into the bottom of each hinge member 103 to retain the panels on the hinge members 3. Next, a first set of spacers 109A are mounted from the top of the closure, each spacer 109A sliding down the hinge member 103 to abut against the top of the panels 105 in the first row 107. A second row 107A of panels 105A are then mounted from the top of the closure, the second row of panels 105A sliding down the members 103 onto the first set of spacers 109A. The assembly of spacers 109 and panels 105 is alternated until the top of the closure is reached. Fasteners (not shown) can be inserted into the tops of the hinge members to retain the panels in place on the hinge members.

I claim:

1. A folding closure having: a plurality of elongate panels, each panel having two parallel surfaces joined by two parallel sides, each panel curved at each side to form a first hinge element on one side curving away from one surface of the panel and back toward the other side and a second hinge element on the other side curving away from the other surface of the panel and back toward the one side, each panel, including its hinge elements, made from a single sheet of uniform thickness; the panels joined by vertical hinge members, each hinge member joining the adjacent sides of two adjacent panels, every second hinge member being on the opposite side of the closure; each hinge member elongated with a first surface and a second surface extending outwardly from one side of the first surface to the other side; an entry slot in the center of first surface extending into the hinge member toward the second surface and away from the first surface, the entry slot diverging into two branch slots curving away from each other toward the sides of the first surface; the first surface slightly bent toward the second surface between its two sides to space the entry slot from an imaginary plane joining the two sides; the hinge elements of adjacent panels mounted in the hinge members, the hinge elements passing together into the central slot and then diverging from each other into the branch slots of the hinge members whereby the panels can be moved relative to the hinge members to have the panels on each hinge member nearly adjacent in a folded position or to have the panels unfolded and abutting the first surface of the hinge members, nearly aligned, and extending away from each other, the bent first surface preventing the unfolded panels from becoming aligned.

2. A folding closure as claimed in claim 1 wherein the panels extend over the height of the closure.

3. A folding closure as claimed in claim 2 wherein the first surface is composed of two straight surface sections when seen in cross-section, each surface section extending toward the entry slot and the other surface section from one side of the first surface, and angled slightly outwardly.

4. A folding closure as claimed in claim 2 including a through hole in each hinge member between the second surface and the branch slots, the through hole opposite the entry slot and intersecting the branch slots, and a fastener at the bottom of each hinge member, fastened into the hole, the fastener retaining the two panels associated with the hinge member on the hinge member.

5. A folding closure as claimed in claim 1 wherein the panels extend partly over the height of the closure.

6. A folding closure as claimed in claim 5 wherein the panels are arranged in rows extending across the width of the closure and the hinge members, and spacers are provided, mounted in the entry and branch slots of the hinge members, to vertically separate the rows of panels from each other.

7. A folding closure as claimed in claim 5 where the first surface is composed of two straight surface sections when seen in cross-section, each surface section extending toward the entry slot and the other surface section from one side of the first surface, and angled slightly outwardly.

8. A folding closure as claimed in claim 5 including a through hole in each hinge member between the second surface and the branch slots, the through hole opposite the entry slot an intersecting the branch slots, and a fastener at the bottom of each hinge member, fastened into the hole, the fastener retaining the panels associated with the hinge member on the hinge member.

9. A hinge assembly as claimed in claim 1 where the first surface of each hinge member, when seen in cross-section, is composed of two straight surface sections, each surface section extending to the entry slot from one side of the first surface, and angled slightly outwardly from the one side of the first surface to provide an included angle between the sections.

10. A hinge assembly as claimed as in claim 9 wherein the included angle between the straight surface sections is between 150° and 170°.

11. A hinge assembly having a hinge member and two adjacent panels, the hinge member being elongated with a first surface and a second surface joining one side of the first surface to its other side, an entry slot in the center of the first surface of the hinge member, the entry slot extending inwardly into the hinge member toward the second surface and away from the first surface and diverging into two branch slots curving away from each other toward the two sides of the first surface of the hinge member, the first surface slightly bent outwardly toward the second surface to space the entry slot from an imaginary straight plane joining the two sides; each panel curved at each side of the panel to provide a hinge element with one hinge element curved in one direction and the other hinge element curved in the other direction, both hinge elements also curved toward each other, the panel, including the hinge elements, made from a single sheet of uniform thickness; the hinge elements of the adjacent panels mounted in the hinge member, the hinge elements passing together into the entry slot and then diverging from each other into the branch slots whereby the panels can be rotated relative to the hinge member to have the panels nearly adjacent in a folded position or to have the panels abutting the first surface, one on each side of the entry slot and nearly aligned, in an unfolded position extending away from each other, the slightly bent first surface of the hinge member preventing the panels from aligning in the unfolded position.

12. A hinge assembly as claimed in claim 11 where the first surface, when seen in cross-section, is composed of two straight surface sections, each surface section extending to the entry slot from one side of the first surface, and angled slightly outwardly from the one side of the first surface to provide an included angle between the sections.

13. A hinge assembly as claimed as in claim 12 wherein the included angle between the straight surface sections is between 150° and 170°.

14. A hinge assembly as claimed in claim 12 including a through hole in the hinge member between the second surface and the branch slots, the through hole opposite the entry slot and intersecting the branch slots.

15. A hinge assembly as claimed in claim 12 wherein the curved hinge element on each side of each panel is curved through a circular arc ranging from between 150° and 170°.

16. A hinge assembly as claimed in claim 11 including a through hole in the hinge member between the second surface and the branch slots, the through hole opposite the entry slot and intersecting the branch slots.

17. A hinge assembly as claimed in claim 16 wherein the curved hinge element on each side of each panel is curved through a circular arc ranging from between 150° and 170°.

18. A hinge assembly as claimed in claim 11 wherein the curved hinge element on each side of each panel is curved through a circular arc ranging from between 150° and 170°.

* * * * *